US007564474B2

(12) United States Patent
Kobayashi

(10) Patent No.: US 7,564,474 B2
(45) Date of Patent: Jul. 21, 2009

(54) LINE HEAD MODULE AND IMAGE FORMING APPARATUS

(75) Inventor: Hidekazu Kobayashi, Toyoshina-machi (JP)

(73) Assignee: Seiko Epson Corporation, Tokyo (JP)

( * ) Notice: Subject to any disclaimer, the term of this patent is extended or adjusted under 35 U.S.C. 154(b) by 361 days.

(21) Appl. No.: 11/174,658

(22) Filed: Jul. 6, 2005

(65) Prior Publication Data

US 2006/0028534 A1 Feb. 9, 2006

(30) Foreign Application Priority Data

Aug. 4, 2004 (JP) ..... 2004-227566

(51) Int. Cl.
*B41J 2/45* (2006.01)
*B41J 2/385* (2006.01)
*B41J 15/14* (2006.01)
*B41J 27/00* (2006.01)

(52) U.S. Cl. ..... 347/238; 347/117; 347/241; 347/256

(58) Field of Classification Search ..... 347/117, 347/238, 241, 256
See application file for complete search history.

(56) References Cited

U.S. PATENT DOCUMENTS 5,908,674 A * 6/1999 Schindler et al. ..... 428/34
6,121,994 A 9/2000 Kuribayashi et al.
6,249,296 B1 * 6/2001 Nemura ..... 347/138
6,297,842 B1 * 10/2001 Koizumi et al. ..... 347/237
6,366,304 B1 * 4/2002 Nakayasu et al. ..... 347/129
6,731,322 B2 * 5/2004 Hori ..... 347/238
6,736,484 B2 * 5/2004 Nakamura ..... 347/40
6,781,617 B2 8/2004 Ohkubo
2001/0022661 A1 * 9/2001 Fujimoto et al. ..... 358/1.8
2003/0053819 A1 * 3/2003 Nomura et al. ..... 399/110
2004/0135876 A1 * 7/2004 Ueda et al. ..... 347/238
2004/0232418 A1 * 11/2004 Koyama et al. ..... 257/59

FOREIGN PATENT DOCUMENTS

JP A 01-244873 9/1989
JP A-2-122955 A 5/1990
JP A-5-297315 11/1993
JP A 06-135052 5/1994
JP A-9-11539 1/1997
JP A-11-198433 7/1999
JP A 11-301024 11/1999
JP A 2003-182137 7/2003
JP A 2003-323975 11/2003
KR 2003-0087649 A 11/2003
WO WO 02/076753 A1 10/2002

* cited by examiner

*Primary Examiner*—Stephen D Meier
*Assistant Examiner*—Sarah Al-Hashimi
(74) *Attorney, Agent, or Firm*—Oliff & Berridge, PLC

(57) ABSTRACT

A line head module includes a line head in which a plurality of organic EL elements is arranged, a lens array made by arranging lens elements that form an image of light from the line head. A first chamber formed on the side of the lens array of the line head is sealed.

4 Claims, 10 Drawing Sheets

LINE HEAD MODULE AND IMAGE FORMING APPARATUS

This application claims the benefit of Japanese Patent Application No. 2004-227566 filed Aug. 4, 2004. The entire disclosure of the prior application is hereby incorporated by reference herein in its entirety.

BACKGROUND

The present invention relates to a line head module used as an exposing unit in an image forming apparatus and to an image forming apparatus having the line head module.

A line printer (image forming apparatus) has been known as a printer using an electrophotographic system. In the line printer, a charging unit, a line-shaped printer head (line head), a developing unit, a transfer unit, etc. are adjacently arranged on a peripheral surface of a photoconductor drum to be exposed. That is, an electrostatic latent image is formed on the peripheral surface of the photoconductor drum charged by the charging unit, as a light-emitting element disposed in the printer head exposes by selectively performing light-emitting operations. Then, the electrostatic latent image is developed by toner supplied from the developing unit, and the developed toner image is transferred to a paper sheet by the transferring unit.

Recently, a light-emitting diode has been generally used as the aforementioned light-emitting element of the printer head. However, there has been a problem that it is difficult to ensure light-emission intensity and responsiveness. Therefore, recently, an image forming apparatus having a light-emitting element array, which uses an electro luminescence element (organic EL element) as a light-emitting element, as an exposing unit has been proposed (for example, see Japanese Unexamined Patent Application Publication No. 11-198433).

The image forming apparatus has adopted an exposing system in which radiant light from the printer head (line head) forms an image on the photoconductor drum through a SELFOC (registered trade mark) lens array manufactured by Nippon Sheet Glass Co., Ltd. The lens array has a plurality of lens elements, which form an image as a nonmagnified erect image, in order to make it possible to form a wide range of image by superposing.

The aforementioned organic EL element has problems that durability is deteriorated due to moisture absorption, which further leads to a short lifetime. However, a measure against the moisture absorption of the organic EL element has not been disclosed at all in the Japanese Unexamined Patent Application Publication No. 11-198433.

SUMMARY

An advantage of the invention is that it provides a line head module and an image forming apparatus capable of preventing deterioration of the durability and a shortened lifetime due to moisture absorption and oxidization of the organic EL element.

According to an aspect of the invention, a line head module includes a line head in which a plurality of organic EL elements is arranged, and a lens array made by arranging lens elements that form an image of light from the line head. A first chamber formed on the side of the lens array of the line head is sealed.

According to another aspect of the invention, a line head module includes a line head in which a plurality of organic EL elements is arranged, a lens array made by arranging lens elements which form an image of light from the line head, and a head case which supports the line head and the lens array. Outer periphery of the line head and the lens array are airtightly jointed with the head case, so that a first chamber formed between the line head and the lens array is sealed.

According to the structure, since the first chamber is sealed, moisture and oxygen can be prevented from getting access to the line head from the lens array. Accordingly, moisture absorption and oxidization of the organic EL element can be suppressed, thereby preventing deterioration of durability and a short lifetime of the organic EL element.

Further, in the above-mentioned structure, it is preferable that a getter agent is disposed in the first chamber.

According to the structure, the getter agent that is a drying agent or deoxidant absorbs moisture or oxygen. Thus, moisture and oxygen can be prevented from getting access to the line head from the lens array, thereby preventing deterioration of durability and a short lifetime of the organic EL element.

Further, in the above-mentioned structure it is preferable that a sealing material containing the getter agent be disposed in a connected part where the line head or/and the lens array and the head case are airtightly connected together.

According to the structure, the sealing material reliably intercepts the permeation of moisture and oxygen, thereby preventing deterioration of durability and a short lifetime of the organic EL element.

According to another aspect of the invention, the line head module includes a line head in which a plurality of organic EL elements is arranged, and a lens array made by arranging lens elements that form an image of light from the line head. A second chamber formed on the opposite side to the lens array of the line head is sealed.

The line head module includes a line head in which a plurality of organic EL elements is arranged, a lens array made by arranging lens elements which form an image of light from the line head, and a head case which supports the line head and the lens array. A lid member is disposed on the opposite side to the lens array of the line head, and outer periphery of the line head and the lid member are airtightly jointed with the head case, so that a second chamber formed between the line head and the lid member is sealed.

According to the structure, since the second chamber is sealed, moisture and oxygen can be prevented from coming into contact to the line head from the lid member. Accordingly, moisture absorption and oxidization of the organic EL element can be suppressed, thereby preventing deterioration of the durability and a shortened lifetime of the organic EL element.

Further, in the above-mentioned structure, it is preferable that a getter agent is disposed in the second chamber.

According to the structure, the getter agent that is a drying agent or deoxidant absorbs moisture or oxygen. Thus, moisture and oxygen can be prevented from getting access to the line head from the lid member, thereby preventing deterioration of durability and a short lifetime of the organic EL element.

Further, in the above-mentioned structure, it is preferable that a sealing material containing the getter agent be disposed in a connected part where the line head or/and the lid member and the head case are airtightly connected together.

According to the structure, the sealing material reliably intercepts the permeation of moisture and oxygen, thereby preventing deterioration of durability and a short lifetime of the organic EL element.

An image forming apparatus according to another aspect of the invention includes the line head module as an exposing unit.

According to the structure, the image forming apparatus having high reliability can be provided by utilizing a line head module having excellent durability.

BRIEF DESCRIPTION OF THE DRAWINGS

The invention will be described with reference to the accompanying drawings, wherein like numbers reference like elements, and wherein.

DETAILED DESCRIPTION OF EMBODIMENTS

Hereinafter, preferred embodiments of the invention will be described with reference to the accompanying drawings. To better understand the accompanying drawings, dimensions of each component are properly modified to be easily shown.

(Line Head Module)

First, a line head module will be described.

Figure 1:
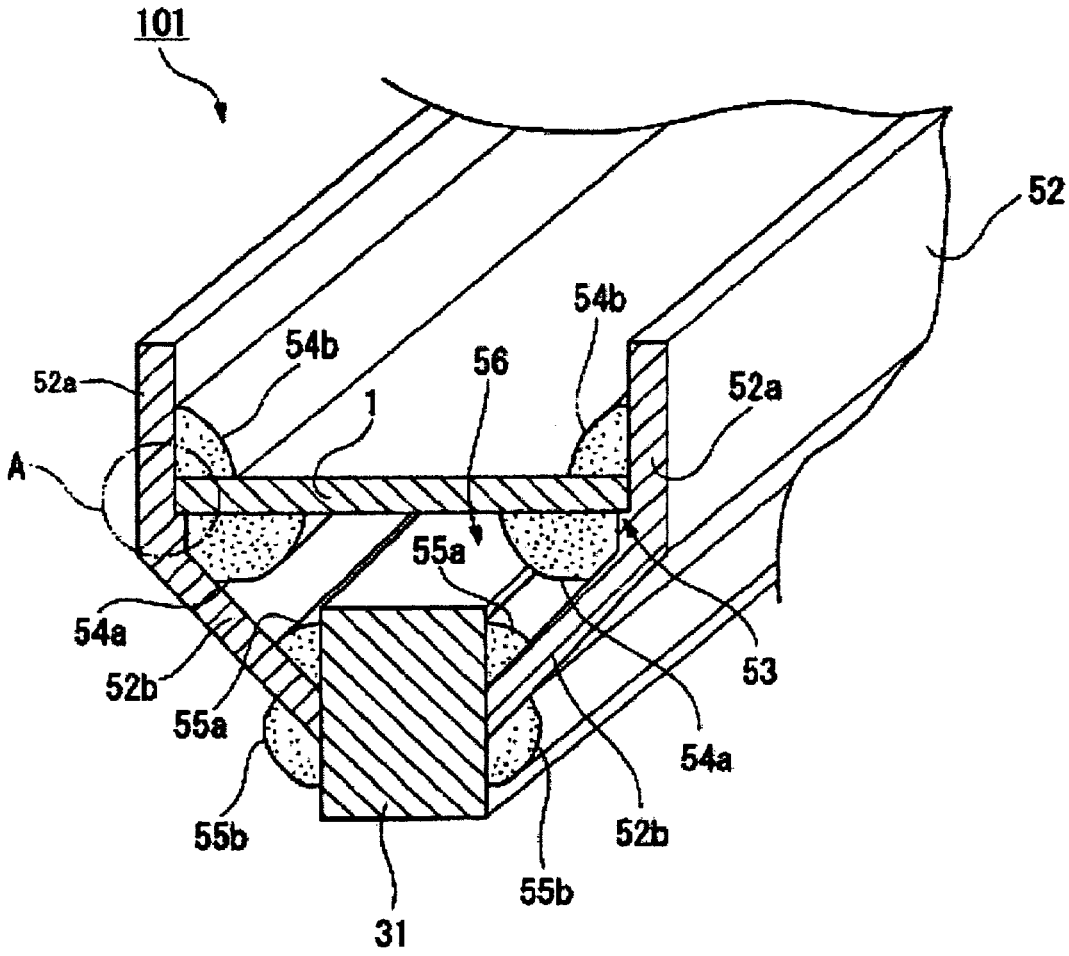
FIG. 1 is a perspective cross-sectional view of a line head module according to an embodiment of the invention.

FIG. 1 is a perspective cross-sectional view of the line head module according to an embodiment. A line head module 101 of the embodiment has a line head 1 in which a plurality of organic EL elements is arranged, a lens array 31 made by arranging lens elements which form an image of light from the line head 1 as a nonmagnified erect image, and a head case 52 which supports an outer periphery of the line head 1 and the lens array 31.

(Line Head)

Figure 2:
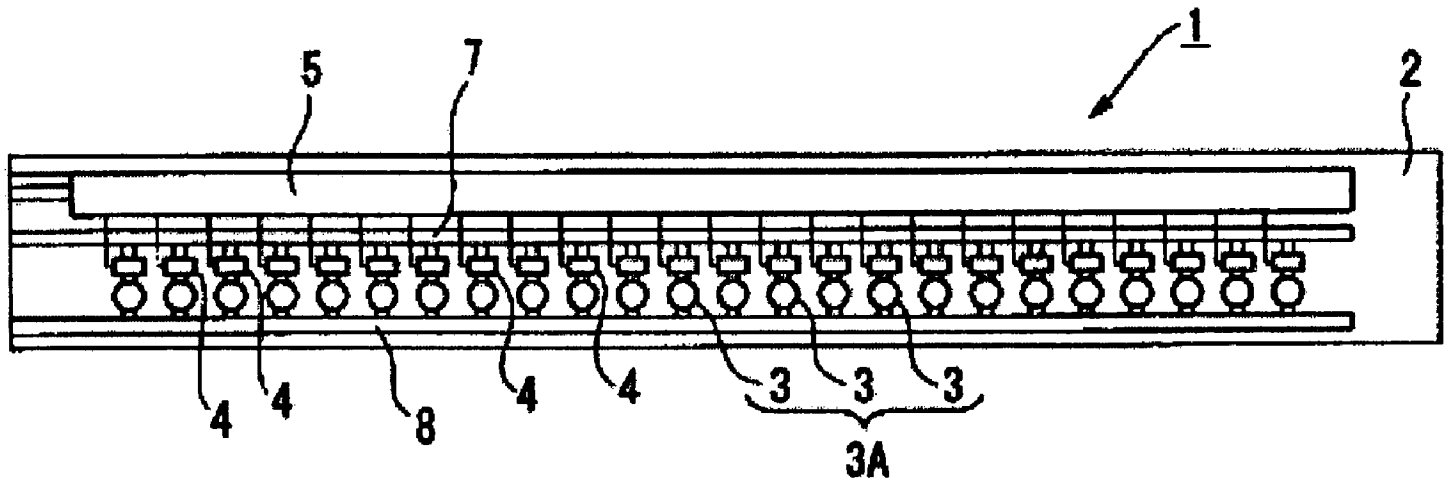
FIG. 2 is a view schematically illustrating the line head.

FIG. 2 is a view schematically illustrating the line head. The line head 1 is formed by integrating a light emitting element line 3A in which a plurality of the organic EL elements 3 is arranged on an elongated rectangular element substrate 2, a group of driver elements consisting of driver elements 4 which drive the organic EL elements 3, and a group of control circuits 5 which control the driving of the driver elements 4 (the group of driver elements).

Further, although the organic EL elements 3 are arranged in one line in FIG. 2, they can be arranged in two lines in zigzags. In this case, a pitch of the organic EL elements 3 in a longitudinal direction of the line head 1 can be reduced such that resolution of the image forming apparatus can be improved.

Each of the organic EL elements 3 have at least an organic light-emitting layer between a pair of electrodes, and emits light by supplying an electric current to the light-emitting layer from the pair of electrodes. One electrode of each of the organic EL elements 3 is connected with a power supply line 8, and the other electrode thereof is connected with a power supply line 7 through the driver element 4. The driver element 4 is composed of a switching element such as a thin film transistor (TFT), a thin film diode (TFD), etc. When the TFT is employed as the driver element 4, the power supply line 8 is connected to the source region of the TFT, and the group of control circuits 5 is connected to gate electrode of the TFT. Then, the driving of the driver element 4 is controlled by the group of the control circuits 5, and supplying a current to the organic EL element 3 is controlled by the driver element 4. The structure and manufacturing method of the organic EL element 3 and the driver element 4 will be described below in detail.

(Lens Array)

Figure 3:
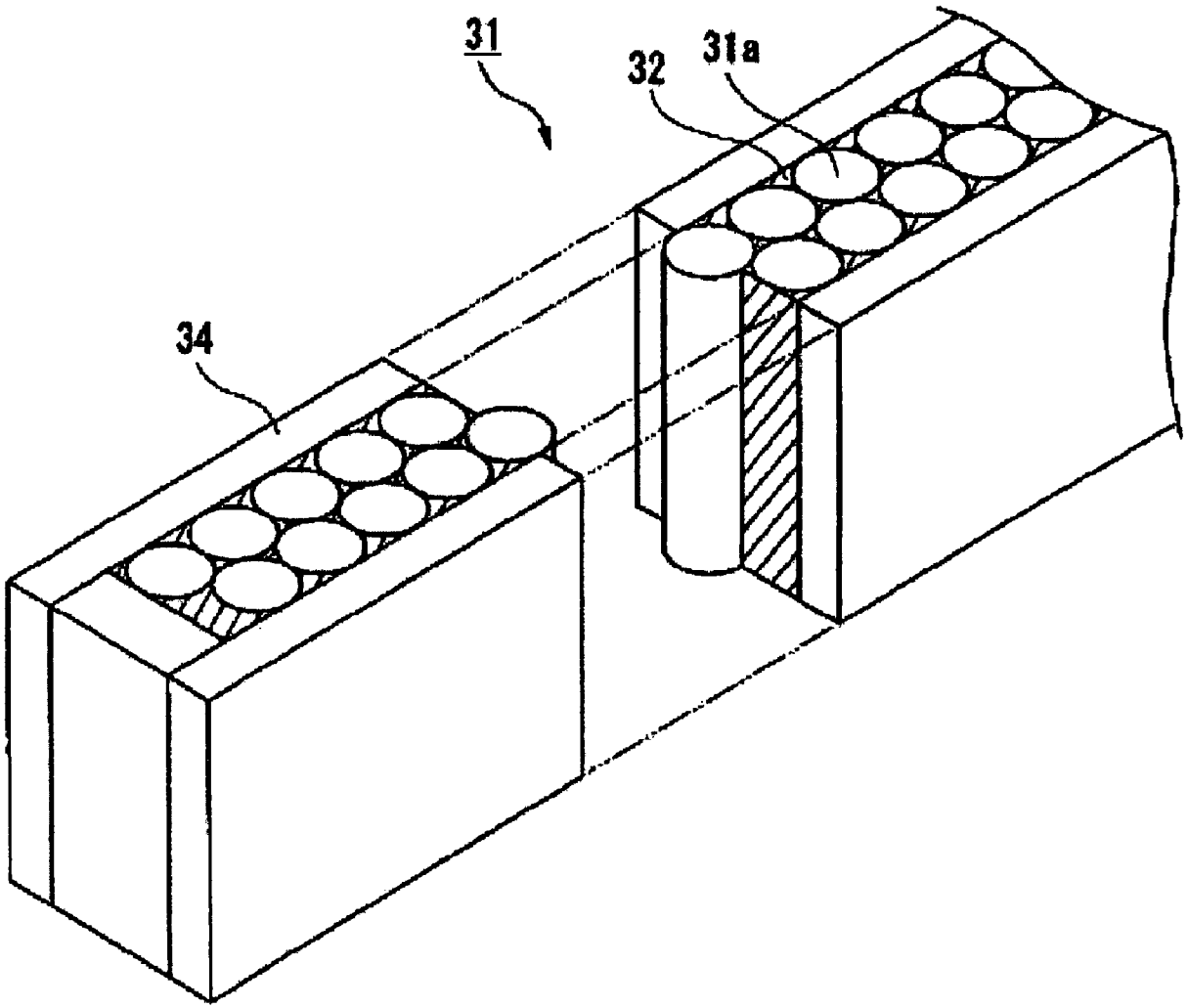
FIG. 3 is a perspective view of a lens array.

FIG. 3 is a perspective view of the lens array. In the lens array 31, there are arranged SELFOC lens elements 31*a* manufactured by Nippon Sheet Glass Co., Ltd. Each of the lens elements 31*a* is formed in a fiber shape whose diameter is about 0.28 millimeters. The lens elements 31*a* are arranged in zigzags, and a black silicon resin 32 is filled into respective gaps between the lens elements 31*a*. Moreover, a frame 34 is disposed around the lens elements 31*a* so as to form a lens array 31.

Each of the lens elements 31*a* has a refractive-index distribution of parabola over the vicinity from the center. For this reason, light incident on each of the lens elements 31*a* is propagated in the lens element 31*a* while meandering at a constant frequency. By adjusting the length of each of the lens elements 31*a*, an image can be formed as a nonmagnified erect image. By the lens elements 31*a* that form an image as a nonmagnified erect image, images formed by adjacent lens elements 31*a* can be superposed, thereby achieving a wide range of image. Therefore, the lens array shown in FIG. 3 can form an image of light from the entire line head with high accuracy.

(Head Case)

Returning to FIG. 1, the line head module 101 according to this embodiment has the head case 52 that supports the outer periphery of the line head 1 and the lens array 1. The head case 52 is made of rigid materials such as A1 in a slit shape. A cross-section perpendicular to a longitudinal direction of the head case 52 has both a top and a bottom end thereof opened, and upper side walls 52*a* and 52*a* are disposed parallel to each other, and lower side walls 52*b* and 52*b* are respectively disposed inclined to the center of the lower side thereof. In addition, although not shown, side walls of both ends in the longitudinal direction of the head case 52 are disposed parallel to each other as well.

The aforementioned line head 1 is disposed inside of the upper sidewalls 52*a* of the head case 52.

Figure 4:
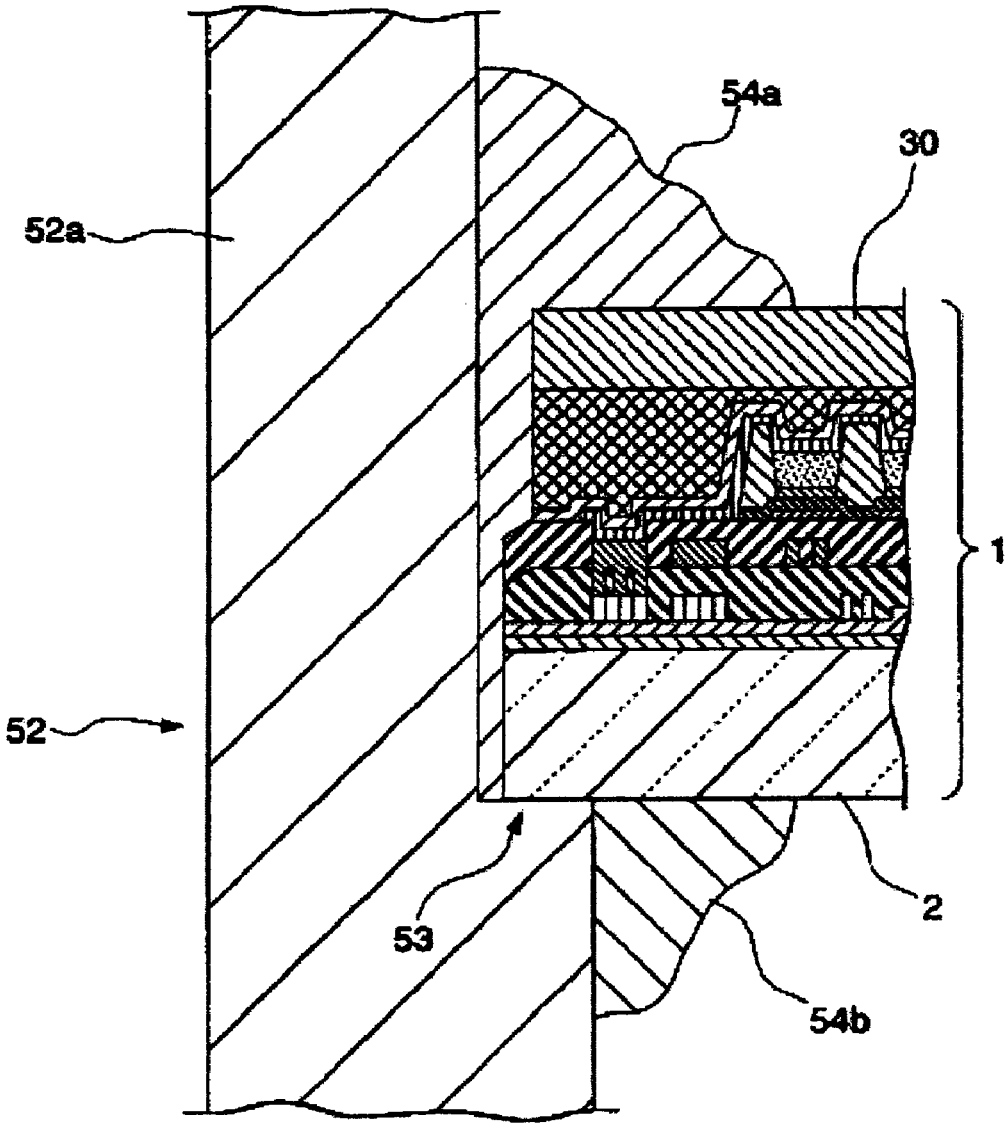
FIG. 4 is an enlarged view showing a coupled portion of the line head.

FIG. 4 is an enlarged view showing a coupled portion (A portion in FIG. 1) of the line head. As shown in FIG. 4, a stepped seat 53 is formed along the entire periphery on an inner surface of the sidewalls 52*a* of the head case 52. A lower surface of the line head 1 abuts on an upper surface of the seat 53, so that the line head 1 is horizontally disposed. Although to be described below in detail, the line head 1 is a bottom emission type, and the element substrate 2 is disposed downward and a sealing substrate 30 is disposed upward.

Sealing materials 54*a* and 54*b* are disposed along the entire circumference of each portion formed by the sidewalls 52*a* of the head case 52 and the line head 1. A sealing material is also disposed in the gaps between the inner surface of the sidewalls 52*a* of the head case 52 and the side surfaces of the line head 1. In this manner, the line head 1 is airtightly jointed with the head case 52. Among these sealing materials, the sealing material 54*a* disposed on the upper surface of the line head 1 is made of UV curable resin such as acryl. The sealing material 54*a* disposed on the lower surface of the line head 1 is made of a thermosetting resin such as epoxy.

The sealing materials 54*a* and 54*b* may contain a getter agent. The getter agent means a drying agent or deoxidant and absorbs moisture or oxygen. By this construction, it is possible to reliably block out permeation of moisture or oxygen. Therefore, moisture absorption and oxidization of the organic EL element formed in the line head can be suppressed, thereby preventing the deterioration of durability and the short lifetime of the organic EL element.

Returning to FIG. 1, the lens array 31 is disposed at a slit shaped aperture formed at the lower end of the head case 52. Each part formed by the sidewalls 52*b* of the head case 52 and the lens array 31 is disposed with the sealing materials 55*a* and 55*b* over the entire periphery. A sealing material is also disposed in gaps between the inner surface of the sidewalls 52*a* of the head case 52 and the sidewalls of the line head 1. By this, the lens array 31 is airtightly jointed with the head case 52. Among these sealing materials, the sealing material 55*a* disposed on the lens array 31 is made of thermosetting resin such as epoxy. The sealing material 55*b* disposed beneath the lens array 31 is made of a UV curable resin such as acryl. The sealing materials 55*a* and 55*b* may contain getter agent.

A first chamber 56 is formed between the line head 1 and the lens array 31 in the head case 52. As described above, since the line head 1 and the lens array 31 are airtightly jointed with the head case 52, the first chamber is sealed. The inside of the first chamber 56 is filled with an inert gas such as nitrogen gas or remains a vacuum.

(Manufacturing Method of Line Head Module)

Hereinafter the manufacturing method of the line head module of the embodiment will be described with reference to FIG. 1. First, the sealing material 54*a* made of thermosetting resin is applied to the entire periphery of the inner surface of the head case 52, along the seat 53 formed on the inner surface of the upper sidewalls 52 of the head case 52. Then, the line head 1 is inserted in the head case 52 so as to be disposed on the upper surface of the seat 53. In this case, the sealing material 54*a* applied along the seat 53 flows so as to be relocated in each part of the inner surface of the head case 52 and the lower surface of the line head 1.

The line head is formed in an elongated rectangular shape, thus the line head 1 is likely to be bent. Therefore, a flatness of the line head 1 is ensured if needed. Next, the sealing material 54*b* made of UV curable resin is applied on the entire periphery of the line head 1 along each part of the inner surface of the head case 52 and the lower surface of the line head 1. Next, a spot UV is irradiated onto the sealing material 54*b* at predetermined intervals, thus the sealing material 54*b* is partially hardened, thereby temporarily fixing the line head 1.

Next, the head case 52 is put into a treatment room of ambient atmosphere, and the following process is performed in the treatment room. The sealing material 55*a* made of thermosetting resin is applied along the entire periphery of the inner surface of the head case 52 along an aperture of the lower end of the head case 52. In addition, the sealing material 55*a* can be applied along the aperture of the lower end as well as the sealing material 54*a* is applied along the seat 53. Then, the lens array 31 is inserted into the aperture of the lower end of the head case 52. In this case, the sealing material 55*a* applied along the aperture of the lower end flows so as to be relocated in each part of the inner surface of the head case 52 and the lower surface of the line head 1.

At this time, the lens array 31 is relatively aligned with respect to the line head 1. While the state of an image formed by the lens array 31 is checked by lighting the organic EL element of the line head 1, both of the lens array 31 and the line head 1 are aligned with each other according to need. Next, the sealing material 55*b* made of a UV curable resin is applied to the entire periphery of the lens array 31 along each part of an outer surface of the head case 52 and a side surface of the lens array 31. Next, a spot UV is irradiated on the sealing material 55*b* at predetermined intervals, thus the sealing material 55*b* is partially hardened, thereby temporarily fixing the lens array 31.

Then, the entire line head module 101 is heated to about 50° C. in a heating furnace. Accordingly, the entire sealing materials 54*a* and 55*a* made of thermosetting resin are hardened. Next, ultraviolet rays are irradiated on the entire line head module 101. Therefore, the entire sealing materials 54*b* and 55*b* made of a UV curable resin are hardened. In addition, the process order can be reversed, so that the hardening of the sealing materials 54*a* and 55*a* made of thermosetting resin may follow the hardening of the sealing materials 54*b* and 55*b* made of a UV curable resin.

As described above, the line head 1 is airtightly jointed with the head case 52 by the sealing materials 54*a* and 54*b*, and the lens array 31 is airtightly jointed with the head case 52 by the sealing materials 55*a* and 55*b*. The first chamber 56 formed between the line head 1 and the lens array 31 is sealed, and then the inside of the first chamber 56 is filled with nitrogen gas.

Therefore, the line head module of this embodiment can prevent moisture and oxygen from contacting the line head 1 from the lens array 31. In this manner, moisture absorption and oxidization of the organic EL element can be suppressed, thereby preventing deterioration of the durability and the shortened lifetime of the organic EL element.

Figure 5:
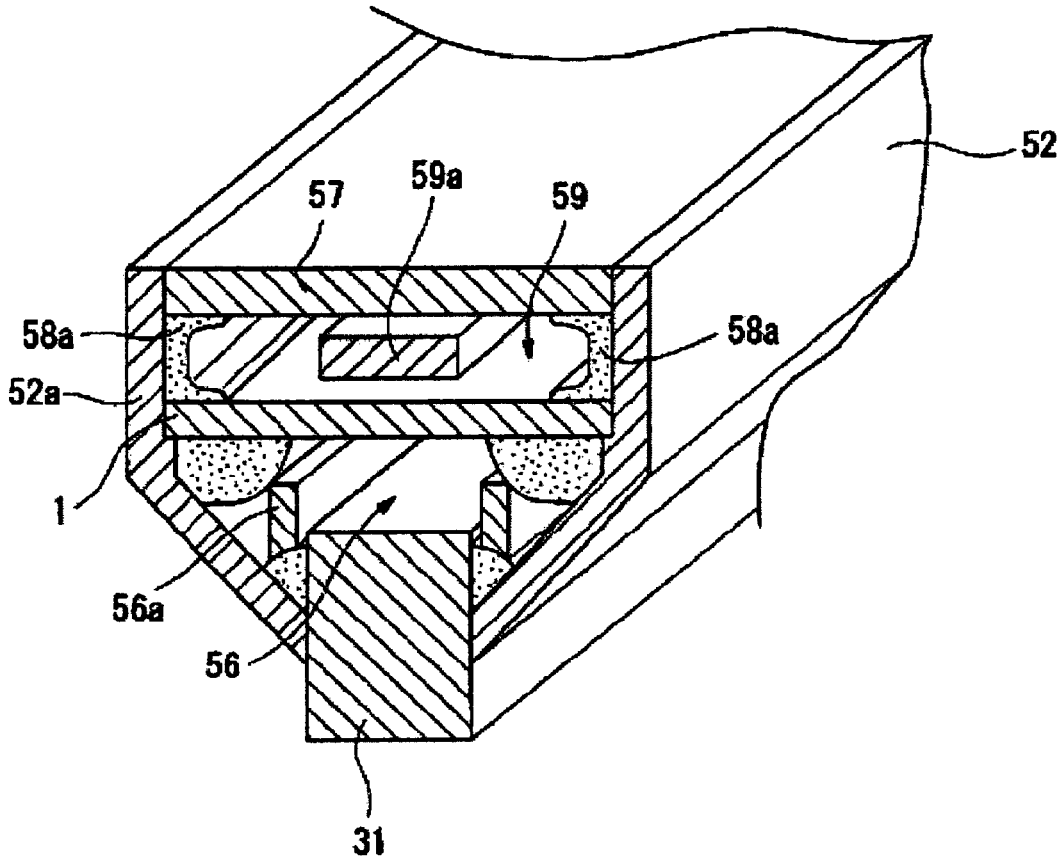
FIG. 5 is a perspective cross-sectional view of a line head module according to a modification of the embodiment.

FIG. 5 is a perspective cross-sectional view of a line head module according to a modification of the embodiment. In this modification, a lid member 57 is disposed at the upper aperture of the head case 52. A second chamber 59 is formed between the line head 1 and the lid member 57 in the head case 52. In each part formed by the sidewalls 52*a* of the head case 52 and the lid member 57, the sealing material 58*a* is disposed along the entire periphery. In this manner, the lid member 57 is airtightly jointed with the head case 52. Accordingly, the second chamber 59 is sealed, and the inside of the second chamber 59 is filled with an inert gas such as nitrogen gas or remains a vacuum.

According to the above-described modification, moisture and oxygen can be prevented from contacting the line head 1 not only from the lens array 31 but also from the lid member 57. In this manner, moisture absorption and oxidization of the organic EL element can be prevented, thereby preventing the deterioration of durability and a short lifetime of the organic EL element.

In addition, in the modification of FIG. 5, a getter agent 56*a* is disposed in the first chamber 56, and a getter agent 59*a* is disposed in the second chamber 59. The getter agent means a drying agent or deoxidant, and keeps a predetermined space dry or in a vacuum by absorbing moisture or oxygen. Accordingly, since the inside of the first chamber 56 and the second chamber 59 can be kept dry or in a vacuum by absorbing moisture or oxygen, moisture absorption and oxidization of the organic EL element is reliably prevented, thereby preventing the deterioration of durability and a short lifetime of the organic EL element.

(Organic EL Element and Driver Element)

Hereinafter, the construction of the organic EL element and the driver element in the line head will be described in detail with reference to FIGS. 6A and 6B.

In case of a so-called bottom emission type which outputs light emitted from a light-emitting layer 60, since it is constructed such that the emitted light is extracted from the element substrate 2, a transparent or semi-transparent element substrate 2 is used. For example, glass, quartz, resin (plastic, plastic film), etc. can be used, in particular, a glass substrate is preferably used.

In addition, in case of a so-called top emission which outputs light emitted from the light-emitting layer 60 to a negative electrode (the counter electrode) 50, since it is constructed such that the emitted light is extracted from a sealing substrate facing the element substrate 2, any one of a transparent or semi-transparent substrate can be used. For example, thermosetting resin, thermoplastic resin or the like can be used as a semi-transparent substrate other than alumina such as ceramics and metal sheets such as stainless steel in which insulation-treatment such as surface oxide is performed.

The bottom emission type is employed in this embodiment, thus transparent glass is used as the element substrate 2.

A circuit part 11 including a TFT 123 (driver element 4) for driving to be connected to a pixel electrode 23 is formed on the element substrate 2, and the organic EL element 3 is formed on the circuit part 11. The organic EL element 3 is constructed such that the pixel electrode 23 which functions as both electrodes, a hole transporting layer 70 which injects/transports a hole from the pixel electrode 23, the light-emitting layer 60 made of organic EL materials, and the negative electrode 50 are formed in order.

Figure 6A:
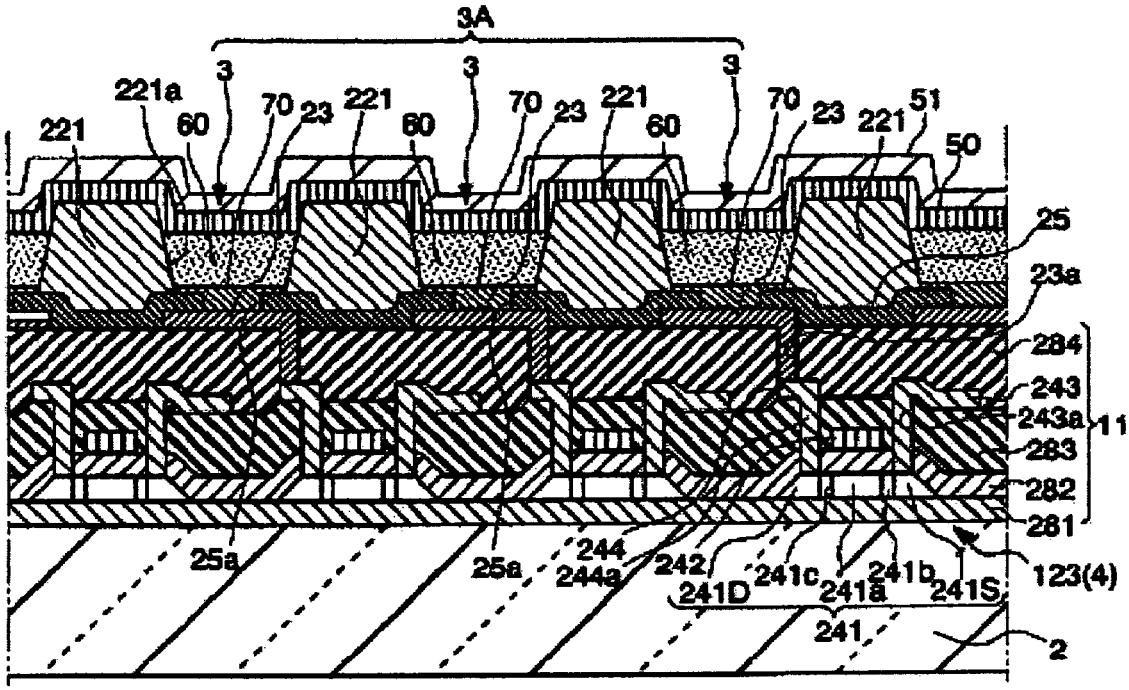
FIG. 6 is an explanatory view of an organic EL element and a driver element.
Figure 6B:
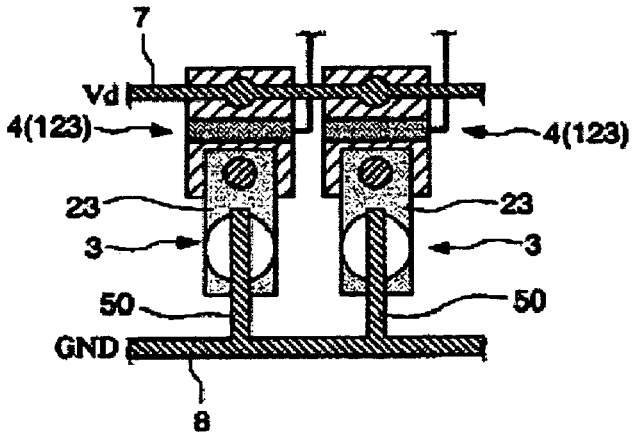

Here, if schematically showing the organic EL element 3 and the TFT 123 (driver element 4) for driving corresponding to FIG. 1A, FIG. 6B shows the schematic view. In FIG. 6B, the power supply line 7 is connected to a source/drain electrode of the driver element 4, and a power supply line 8 is connected to the negative electrode 50 of the organic EL element 3.

In the above construction, the organic EL element 3 is designed to emit light as a hole injected from the hole transporting layer 70 is combined with an electron from the negative electrode 50 in the light-emitting layer 60, as shown in FIG. 6A.

In this embodiment, an inorganic partition wall 25 made of lyophilic insulating materials such as $SiO_2$ is formed on the pixel electrode 23, and an aperture 25*a* is formed in the inorganic partition wall 25. Here, since the inorganic partition wall 25 is made of insulating materials, a current does not flow to an area where the inorganic partition wall 25 covers in a function layer formed to face inside the aperture 25*a*. Therefore, an area where light emits, that is, a light-emitting area is defined by the aperture 25*a* of the inorganic partition wall 25.

If the pixel electrode 23 which functions as both electrodes is, in particular, the bottom emission type, the pixel electrode 23 is formed of a transparent conductive material, specifically, ITO is preferred.

As materials which form the hole transporting layer 70, in particular, dispersion liquid of 3,4-polyethylene deoxythiophene/polystyrenesulfonic acid (PEDOT/PSS), that is, dispersion liquid made as 3,4-polyethylene deoxythiophene is dispersed in polystyrenesulfonic acid serving as dispersion medium and then further dispersed in water is preferably used.

In addition, the materials that form the hole transporting layer 70 are not limited to the above-mentioned materials. For example, it may be used those allowing polystyrene, polypyrrole, polyaniline, polyacetylene or their derivatives to be dispersed in the appropriate dispersion medium, for example, the polystyrenesulfonic acid.

Known light-emitting materials, which emit fluorescence or phosphorescence, are used as materials, which form the light-emitting, layer 60. For example, although emission wavelength band adopts light-emitting layers corresponding to red color, the light-emitting layers may correspond to green or blue color.

Materials including (poly)fluorene (PF) derivative, (poly) paraphenylenevinylene (PPV) derivative, polyphenylene (PP) derivative, polyparaphenylene (PPP) derivative, polyvinylcarbazole (PVK) derivative, polythiophene derivative, polysilane such as polymethylphenylsilane (PMPS) derivative, and the like as a material for forming the light-emitting layer 60 are properly used. Polymeric materials such as perylene dye, coumarin dye, rhodamine dye and low molecule materials such as rubrene, perylene, 9,10-diphenylanthracene, tetraphenyl butadiene, nile red, coumarin 6, quinacridone can be used for doping.

The negative electrode 50 is formed by covering the light-emitting layer 60. For example, Ca is formed with the thickness of 20 nanometers, and Al is formed on the Ca with the thickness of 200 nanometers to form an electrode having a laminated-layer structure, and Al also functions as a reflective layer.

Furthermore, a sealing substrate (not shown) is adhered on the negative electrode 50 sandwiching an adhesion layer therebetween.

As described above, the circuit part 11 is disposed beneath the organic EL element 3. The circuit part 11 is formed on the element substrate 2. That is, a ground surface protective layer 281 having $SiO_2$ as a main constituent is formed as a ground surface on the surface of the element substrate 2, and a silicon layer 241 is formed on the ground surface. A gate insulating layer 282 having $SiO_2$ and/or SiN as main constituents is formed on the surface of the silicon layer 241.

In the silicon layer 241, an area where the gate electrode 242 is overlapped by inserting the gate-insulating layer 282 is set to be a channel area 241*a*. The gate electrode 242 is a portion of scan line. In the meantime, a first inter-layer insulating layer 283 having $SiO_2$ as a main constituent is formed on the surface of the gate insulating layer 282 which covers the silicon layer 241 and forms the gate electrode 242.

Further, in the silicon layer 241, while a lightly doped source region 241*b* and a heavily doped source region 241S are formed at the source side of the channel area 241*a*, a lightly doped drain region 241*c* and a lightly doped drain region 241D are formed at the drain side of the channel area 241*a* and a so called LDD (Light Doped Drain) structure is realized. Among these, the heavily doped source region 241S is connected to a source electrode 243 via a contact hole 243*a*, which is formed along the gate insulating layer 282 and the first inter-layer insulating layer 283. The source electrode 243 is constructed as a portion of a power supply line (not shown). On the other hand, the heavily doped drain region 241D is connected to a drain electrode 244 consisting of the same layer as a source electrode 243 via a contact hole 244*a* which is formed along the gate insulating layer 282 and the first inter-layer insulating layer 283.

A planarized film 284 having, for example, an acryl resin or the like as a main constituent is formed on an upper layer of the first inter-layer insulating layer 283 where the source electrode 243 and the drain electrode 244 are formed. The planarized film 284 formed of resins having heat resistance and insulation such as acryl, and polyimide is known to be formed so as to eliminate concavity and convexity of the surface made by the TFT 123 (driver element 4) for driving or the source electrode 243 and the drain electrode 244.

The pixel electrode 23 consisting of ITO or the like is formed on the surface of the planarized film 284, and is connected to the drain electrode 244 via the contact hole 23*a* formed in the planarized film 284. That is, the pixel electrode 23 is connected to the heavily doped drain region 241D of the silicon layer 241 via the drain electrode 244.

The pixel electrode 23 and the aforementioned inorganic partition wall 25 are formed on the surface of the planarized film 284 on which the pixel electrode 23 is formed, moreover, an organic partition wall 221 is formed on the inorganic partition wall 25. On the pixel electrode 23, the hole transporting layer 70 and the light-emitting layer 60 are laminated in order from the pixel electrode 23 inside of the aperture 25*a* formed in the inorganic partition wall 25 and an aperture 221*a* formed in the organic partition wall 221, that is, in a pixel area. By this, the function layer is formed.

(Manufacturing Method of Line Head)

Hereinafter, the manufacturing method of the above constructed line head will be described.

Figure 7A:
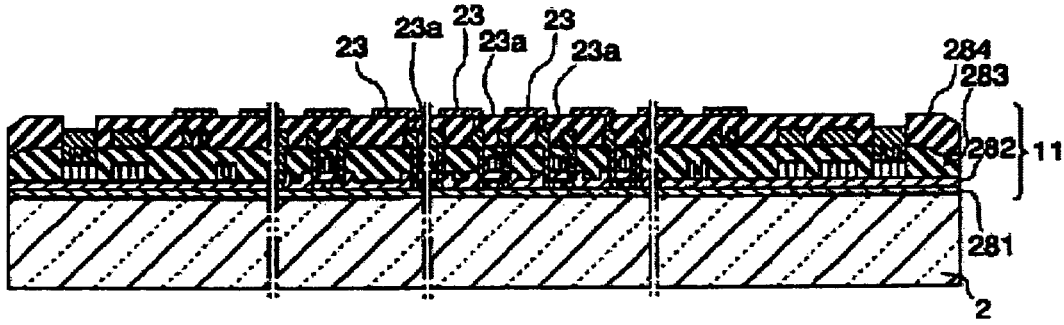
FIG. 7 is an explanatory view of a manufacturing process of the line head.

First, the ground surface protective layer 281 is formed on the surface of the element substrate 2 as shown in FIG. 7A, furthermore a polysilicon layer or the like is formed on the ground surface protective layer 281, and the circuit part 11 is formed by the polysilicon layer or the like.

After that, a transparent conductive film is formed by ITO or the like. The transparent conductive film serves as the pixel electrode 23 so as to cover the entire element substrate 2. By patterning the conductive film, the pixel electrode 23 conducted with the drain electrode 244 is formed via the contact hole 23*a* of the planarized film 284.

Figure 7B:
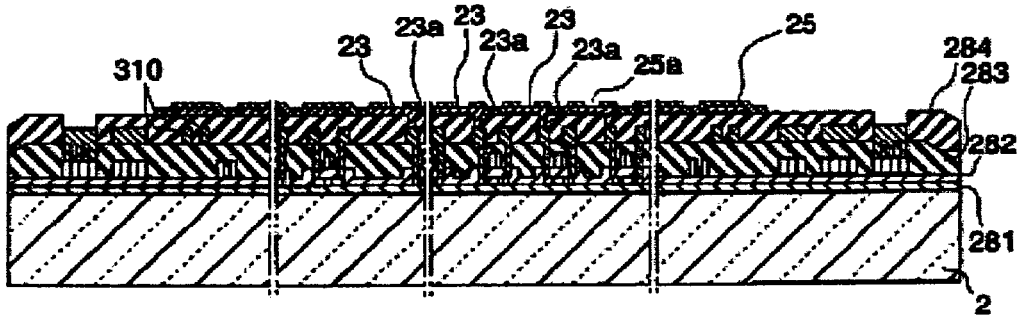

Further, an insulating material such as $SiO_2$ or the like is formed into a film by CVD method so as to form a partition wall layer (not shown) on the pixel electrode 23 and the planarized film 284, subsequently patterning the partition wall layer by the known photolithographic method and etching method. By this, the aperture 25*a* is formed in every pixel area of each organic EL element formed as shown in FIG. 7B, and the inorganic partition wall 25 is formed.

Figure 7C:
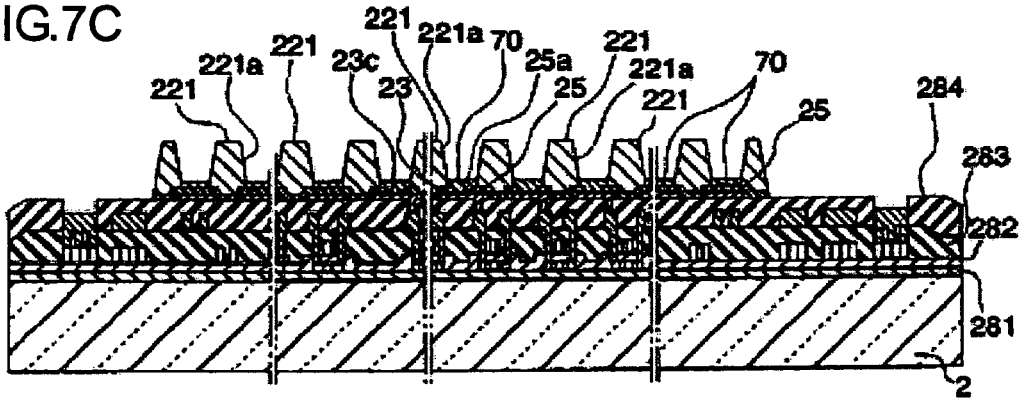

Furthermore, the organic partition wall 221 is formed of resins or the like in a location surrounding the pixel area, that is, a predetermined location of the inorganic partition wall 25 as shown in FIG. 7C.

A lyophilic area and a lyophobic area are formed on the surface of element substrate 2. In this embodiment, each area is formed by plasma processing. Specifically, the plasma processing includes a pre-heating process, a lyophilic process of processing the surface of the organic partition wall 221, a wall surface of the aperture 221 a, a electrode surface 23*c* of the pixel electrode 23, and the surface of the inorganic partition wall 25 to be lyophilic, a lyophobic process of processing the upper surface of the organic partition wall 221 and a wall surface of the aperture 221*a* to be lyophobic, and a cooling process.

A base material (the element substrate 2 including a bank) is heated to a predetermined temperature, for example, 70 to 80° C. Then, the plasma processing ($O_2$ plasma processing) having oxygen as a reactant gas at atmospheric pressure is performed as a lyophilic process. After that, the plasma processing ($CF_4$ plasma processing) having methane tetrafluoride as reactant gas at atmospheric pressure is performed as a lyophobic process. After the base material, which is heated due to the plasma processing, is cooled down to a room temperature, thereby forming the lyophilic area and the lyophobic area.

Although the CF4 plasma processing is somewhat influenced by the electrode surface 23*c* of the pixel electrode 23 and the inorganic partition wall 25, ITO which is a material for the pixel electrode 23 and $SiO_2$, $TiO_2$ which are constituent materials for the inorganic partition wall 25 are lack of lyophilic properties to fluoride. Thus, hydroxyl, which is given in the lyophilic process, is not substituted by fluoride, thereby maintaining the lyophilic properties.

Then, the hole transporting layer 70 is formed by a process of forming a hole transporting layer. In the process of forming a hole transporting layer, in particular, an ink jet method is preferably used as a liquid drop discharging method. That is, a material which forms the hole transporting layer is selectively disposed on the electrode face 23*c* by the ink jet method, thereby applying the material. After that, the hole transporting layer, 70 is formed on the electrode 23 by drying processing and heat-treating. Materials made as the aforementioned polyethylene deoxythiophene/polystyrene-sulfonic acid (PEDOT/PSS) is dissolved in a polar solvent such as isopropyl alcohol is used for forming the hole transporting layer 70.

Here, in case of forming the hole transporting layer 70 by the ink jet method, first, an ink jet head (not shown) is filled with materials for forming the hole transporting layer. Then, a discharging nozzle of the ink jet head is positioned to face the electrode face 23*c* located in the aperture 25*a* formed in the inorganic partition wall 25. While the ink jet head and the base material (the element substrate 2) are relatively moved, a droplet, which is a controlled liquid measure of one drop from the discharging nozzle, is discharged to the electrode surface 23*c*. Afterward, the discharged droplet is drying process. Then, by evaporating dispersion medium and solvent contained in the materials for the hole transporting layer, the hole transporting layer 70 is formed.

At this moment, the droplet discharged from the discharging nozzle is scattered on the electrode face 23*c* which is lyophilic treated, and fills inside the aperture 25*a* of the inorganic partition wall 25 so as to face the inside of the aperture 25*a*. In the meantime, on the upper surface of the organic partition wall 221, which is lyophobic processed, the droplet is not attached thereto but reflected therefrom. Therefore, the top face of the organic partition wall 221 is never soaked with the droplet even though portions of the droplet deviate from a predetermined discharging location and splash the surface of the organic partition wall 221, therefore, the splashed droplet is drawn to the inside the aperture 25*a* of the inorganic partition wall 25.

After the process of forming the hole transporting layer, the remaining of the process is preferably performed in an inert gas atmosphere such as a nitrogen atmosphere or an argon atmosphere.

Figure 8A:
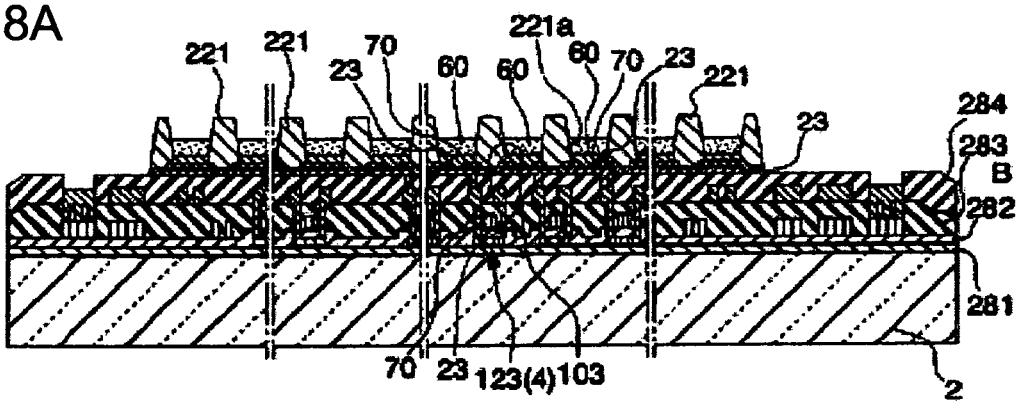
FIG. 8 is an explanatory view of the manufacturing process of the line head.

After that, the light-emitting layer 60 is formed by the process of forming the light-emitting layer as shown in FIG. 8A. In the process of forming the light-emitting layer, the ink jet method that is a liquid drop discharging method is preferably used in the same manner as the forming of the hole transporting layer 70. That is, by the ink jet method, materials forming the light-emitting layer is discharged on the hole transporting layer 70, then the light-emitting layer 60 is formed inside the aperture 221*a* formed in the organic partition wall 221, that is, on the pixel area.

The function layer of the invention can be formed by the process of forming the hole transporting layer 70 and the process of forming the light-emitting layer 60.

Figure 8B:
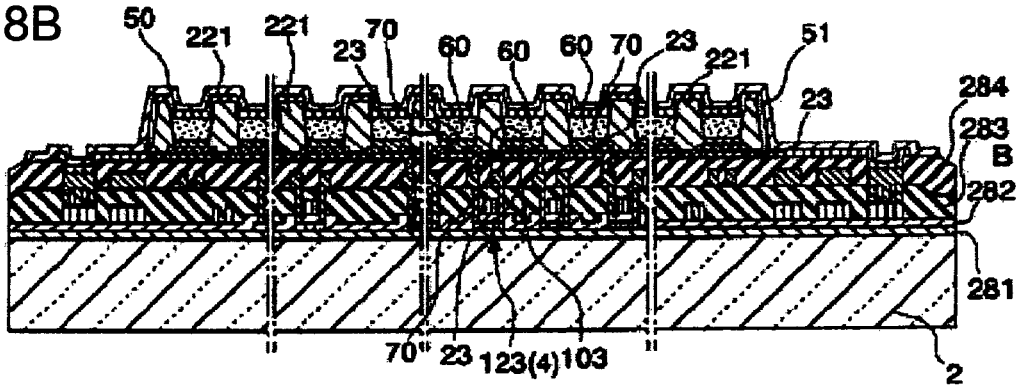

After that, the negative electrode 50 is formed by the process of forming the negative electrode as shown in FIG. 8B. The negative electrode 50 generally employs a laminated structure such as an electron injection layer, a conductive layer in order to effectively emit the EL element. For example, metal materials such as aluminum can be used. Since an evaporating method or a sputtering method are performed in forming the negative electrode 50, unlike the forming of the hole transporting layer 70 and the light-emitting layer 60, forming materials are not selectively disposed in the pixel area, thereby forming the forming materials on the substantially entire surface of the element substrate 2. The negative electrode 50 is prevented from being formed in the vicinity of the substrate as shown in FIG. 8B, by positioning the element substrate 2 and a metal mask (not shown) and forming a film of the negative electrode 50 with the evaporation method and the sputtering method.

Figure 8C:
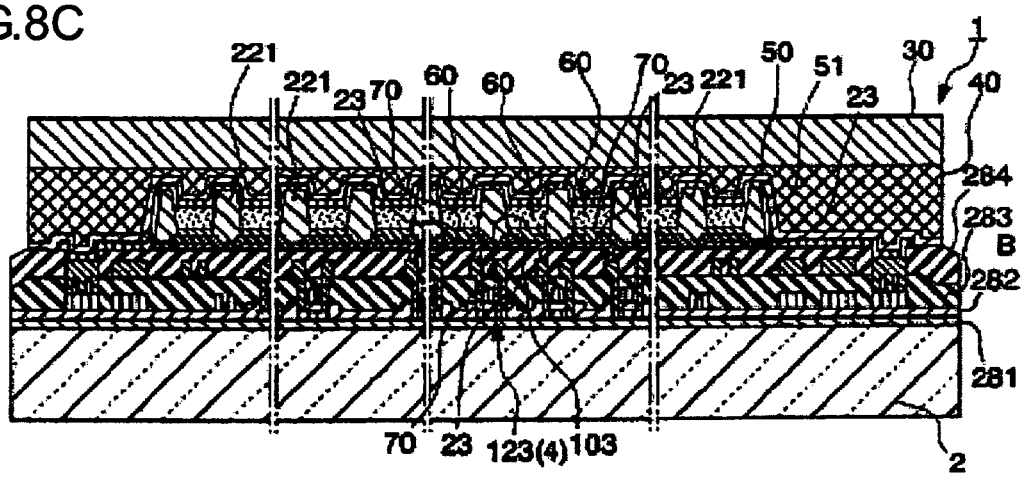

Afterward, the sealing substrate 30 is attached by the sealing process as shown in FIG. 8C. In the sealing process, a transparent adhesive 40 is applied between the transparent sealing substrate 30 and the element substrate 2, so that the sealing substrate 30 is attached to the element substrate 2; in order to exclude air bubble.

In addition, although the organic EL element is used as the EL element formed in the line head 1 of the invention according the embodiment, an inorganic EL element can be used besides the organic EL element.

(Type of Usage of Line Head Module)

Hereinafter, a type of usage of the line head module of the embodiment will be described.

The line head module of this embodiment is used as an exposing unit in an image forming apparatus. In this case, the line head module is disposed to face a photoconductor drum, and form an image of light from the line head as a nonmagnified erect image on the photoconductor drum by a lens array.

(Tandem-Type Image Forming Apparatus)

First, a tandem-type image forming apparatus will be described.

Figure 9:
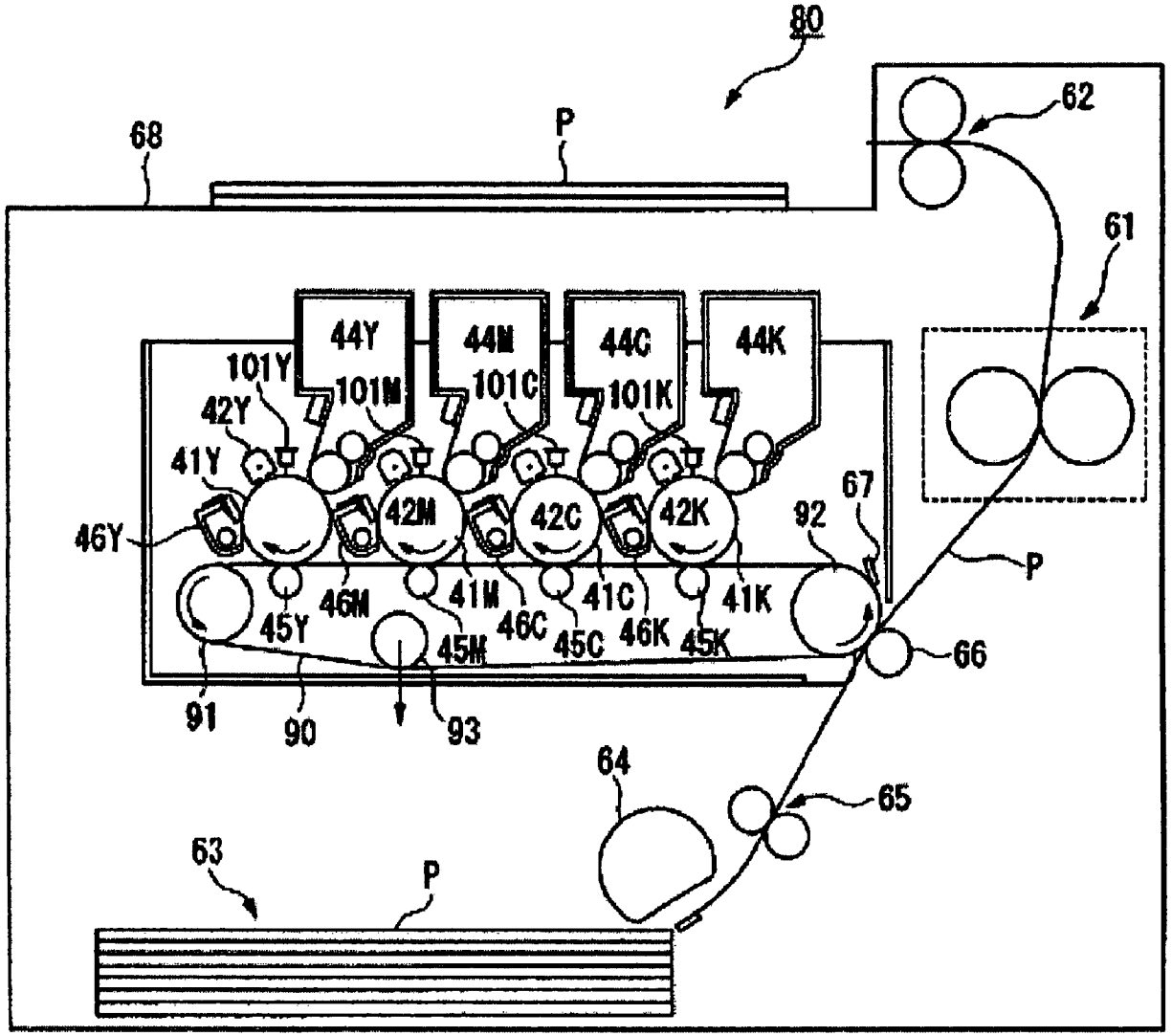
FIG. 9 is a schematic diagram of an image forming apparatus of a tandem system.

FIG. 9 is a schematic diagram of the tandem-type image forming apparatus, and the reference numeral 80 indicates the image forming apparatus. The image forming apparatus 80 is constituted as a tandem type image forming apparatus 80 in which four line heads 101K, 101C, 101M, and 101Y are arranged at exposure positions of corresponding four photoconductor drums (image carriers) 41K, 41C, 41M, and 41Y with the same configuration.

As shown in FIG. 9, the image forming apparatus includes a driving roller 91, a driven roller 92, a tensioning roller 93, and an intermediate transfer belt 90 which is stretched over each roller and driven to be circulated in the direction (in the counterclockwise direction) indicated by an arrow in FIG. 9. The photoconductor drums 41K, 41C, 41M, and 41Y each having a photosensitive layer on its outer peripheral surface are arranged with a predetermined gap with respect to the intermediate transfer belt 90. The outer peripheral surface the photoconductor drums 41K, 41C, 41M, and 41Y are photoconductive layers as image carriers.

The characters K, C, M, and Y added to the reference numerals indicate black, cyan, magenta, and yellow, respectively. Thus, the photoconductor drums are for black, cyan, magenta, and yellow. These reference numerals are also applied to the other kinds of members. The photoconductor drums 41K, 41C, 41M, and 41Y are driven and rotated in the direction (clockwise direction) indicated by an arrow in FIG. 9, in synchronization with the driving of the intermediate transfer belt 90.

A charging unit (a corona charger) 42(K, C, M, or Y) for uniformly charging the outer peripheral surface of the photoconductor drum 41 (K, C, M, or Y), and the line head module 101 of the invention (K, C, M, or Y) for sequentially scanning the outer peripheral surface uniformly charged by the charging unit 42 (K, C, M, or Y), in synchronization with the rotation of the photoconductor drum 41 (K, C, M, or Y) are arranged around each photoconductor drum 41 (K, C, M, or Y).

The image forming apparatus is provided with a developing unit 44 (K, C, M, or Y) for imparting toner, serving as a developer, onto an electrostatic latent image formed by the line head module 101 (K, C, M, or Y) thereby for converting the image into a visible image (toner image), a primary transfer roller 45 (K, C, M, or Y) as a primary transfer unit for sequentially transferring the toner image developed by the developing unit 44 (K, C, M, or Y) onto the intermediate transfer belt 90, serving as a primary transfer target, and a cleaning unit 46 (K, C, M, or Y) for removing toner remaining on the surface of the photoconductor drum 41 (K, C, M, or Y) after the transfer.

In this case, each line head module 101 (K, C, M, or Y) is arranged such that the arrayed direction of the organic EL element is aligned with the generatrix of each photoconductor drum 41 (K, C, M, or Y). Further, the light emission energy peak wavelength of each line head module 101 (K, C, M, or Y) is set to coincide approximately with the sensitivity peak wavelength of each photoconductor drum 41 (K, C, M, or Y).

In the developing unit 44 (K, C, M, or Y), for example, a non-magnetic single-component toner is used as the developer. The single-component developer is conveyed to a developing roller by, for example, a supplying roller. The film thickness of the developer adhered to the surface of the developing roller is regulated by a control blade. Then, the developing roller is brought into contact with or pressed against the photoconductor drum 41 (K, C, M, or Y), so as to cause the developer to be adhered thereto depending on the potential level on the photoconductor drum 41 (K, C, M, or Y), so that development into a toner image is performed.

The four toner images of black, cyan, magenta, and yellow generated by such four single-color toner image forming stations are primarily transferred sequentially onto the intermediate transfer belt 90 owing to a primary transfer bias applied on each primary transfer roller 45 (K, C, M or Y). A fall-color toner image generated by overlaying these single-color toner images on the intermediate transfer belt 90 is secondarily transferred onto a recording medium P, such as a paper sheet, by a secondary transfer roller 66. The image is fixed on the recording medium P during the passage through a pair of fixing rollers 61, serving as a fixing unit. The recording medium P is then ejected through a pair of sheet ejection rollers 62 onto a sheet ejection tray 68 provided on the top of the device.

Furthermore, in FIG. 9, reference numeral 63 indicates a sheet feed cassette for holding a stack of a large number of recording media P. Reference numeral 64 indicates a pick-up roller for feeding the recording medium P one by one from the sheet feed cassette 63. Reference numeral 65 indicates a pair of gate rollers for defining the timing of feeding the recording medium P to a secondary transfer section of the secondary transfer roller 66. Reference numeral 66 indicates the secondary transfer roller serving as a secondary transfer unit forming a second transfer part between the secondary transfer roller 66 and the intermediate transfer belt 90. Reference numeral 67 indicates a cleaning blade serving as a cleaning unit for removing the toner remaining on the surface of the intermediate transfer belt 90 after the secondary transfer.

(Four-Cycle-Type Image Forming Apparatus)

Next, a four-cycle-type image forming apparatus will be described.

Figure 10:
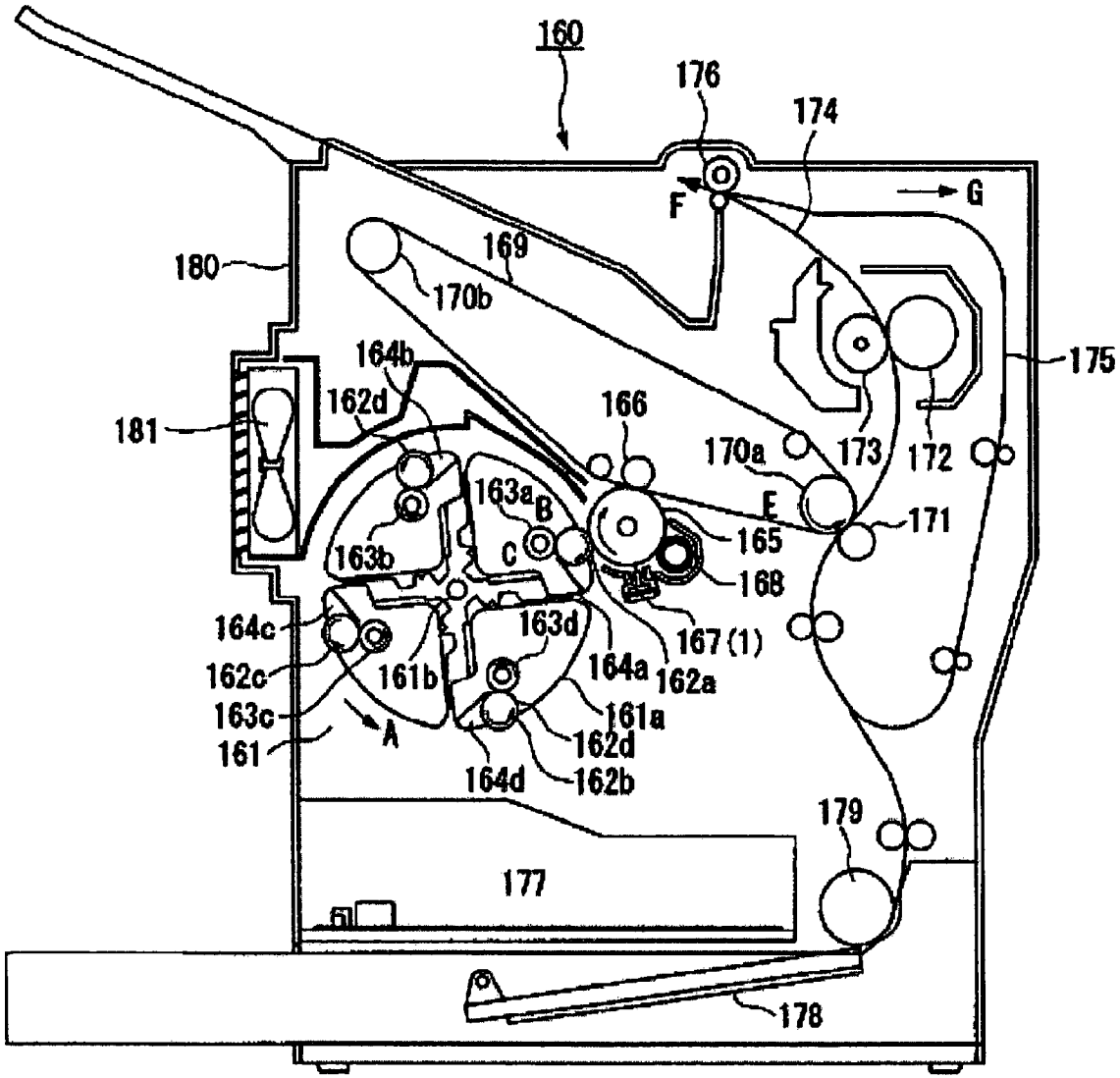
FIG. 10 is a schematic diagram of an image forming apparatus of a four-cycle system.

FIG. 10 is a schematic diagram of the image forming apparatus of a four-cycle system. As shown in FIG. 10, this image forming apparatus 160 includes a developing unit 161 having rotary arrangement, a photoconductor drum 165 functioning as an image carrier, a line head module 167 of this embodiment functioning as an image writing unit (an exposing unit), an intermediate transfer belt 169; a sheet conveying path 174, a heating roller 172 of a fixing device, and a sheet feeding tray 178.

In the developing unit 161, a developing rotary 161*a* turns in the direction indicated by an arrow A about a shaft 161*b*. The inside of the developing rotary 161*a* is divided into four sections each provided with one of the image forming units for four colors of yellow (Y), cyan (C), magenta (M), and black (K). Reference numerals 162*a* to 162*d* indicate developing rollers each arranged in each of the image forming units for four colors and rotating in the direction indicated by an arrow B. Reference numerals 163*a* to 163*d* indicate toner supply rollers rotating in the direction indicated by an arrow C. Reference numerals 164*a* to 164*d* indicate control blades for regulating the toner thickness to a predetermined value.

In FIG. 10, reference numeral 165 indicates a photoconductor drum functioning as an image carrier as described above, reference numeral 166 indicates a primary transfer member, reference numeral 168 indicates a charger. Reference numeral 167 is a line head module functioning as an image-writing unit (exposing unit). Further, the photoconductor drum 165 is driven by a driving motor (not shown), such as a stepping motor, in a direction indicated by an arrow D, which is reverse to the rotating direction of the developing roller 162*a*.

The intermediate transfer belt 169 is stretched over a driving roller 170*a* and a driven roller 170*b*. The driving roller 170*a* is linked to a driving motor of the photoconductor drum 165 so as to transmit power to the intermediate transfer belt 169. When this driving motor operates, the driving roller 170*a* of the intermediate transfer belt 169 rotates in the direction indicated by an arrow E, which is reverse to the rotating direction of the photoconductor drum 165.

The sheet conveying path 174 is provided with a plurality of conveying rollers and a pair of sheet ejection rollers 176 so as to convey a paper sheet. An image (toner image) on one side carried by the intermediate transfer belt 169 is transferred to one side of the paper sheet at the position of the secondary transfer roller 171. The secondary transfer roller 171 is brought into contact with or separated from the intermediate transfer belt 169 by a clutch mechanism. When the clutch operates, the secondary transfer roller 171 is brought into contact with or separated from the intermediate transfer belt 169, thus the image is transferred to the paper sheet.

Next, the paper sheet carrying the image transferred as described above undergoes a fixing process in the fixing device having a fixing heater H. The fixing device is provided with a heating roller 172 and a pressure roller 173. The paper sheet after the fixing process is drawn into the pair of sheet ejection rollers 176 to travel in the direction indicated by an arrow F. In this state, when the pair of sheet ejection rollers 176 turns reversely, the paper sheet travels reversely in the direction indicated by an arrow G through a sheet conveying path 175 for double-side printing. Reference numeral 177 indicates an electric equipment box. Reference numeral 178 indicates a sheet feeding tray for housing paper sheets. Reference numeral 179 indicates a pick-up roller provided at the exit of the sheet feeding tray 178.

The driving motor used for driving the conveying rollers in the sheet conveying path is, for example, a low-speed brushless motor. A stepping motor is used for the intermediate transfer belt 169 because of the necessity of color shift correction. Each of the motors is controlled by signals provided from a controller, which is not shown.

In the state shown in FIG. 10, an electrostatic latent image of yellow (Y) is formed on the photoconductor drum 165, and a high voltage is applied to the developing roller 162*a*. As a result, an image of yellow is formed on the photoconductor drum 165. When both the rear side image and the front side image of yellow are carried by the intermediate transfer belt 169, the developing rotary 161*a* turns by 90 degrees in the direction indicated by the arrow A.

The intermediate transfer belt 169 makes one turn, and returns to the position of the photoconductor drum 165. Next, the two sides of images of cyan (C) are formed on the photoconductor drum 165. These images are then overlaid on the image of yellow carried on the intermediate transfer belt 169. Thereafter, similar processes are repeated. That is, the developing rotary 161 turns by 90 degrees, and then the intermediate transfer belt 169 makes one turn after the transfer of the images.

In order that all the images of four colors are transferred to the intermediate transfer belt 169, the intermediate transfer belt 169 needs to makes four turns. Thereafter, the turning position is controlled so that the images are transferred to a paper sheet at the position of the secondary transfer roller 171. A paper sheet fed from the sheet feeding tray 178 is conveyed along the conveying path 174, and then one of the color images is transferred to one side of the paper sheet at the position of the secondary transfer roller 171. The paper sheet having the transferred image on one side thereof is reversed by the pair of sheet ejection rollers 176 as described above, and then waits in the conveying path. Thereafter, at an appropriate timing, the paper sheet is conveyed to the position of the secondary transfer roller 171, so that the other color image is transferred to the other side. A housing 180 is provided with an exhaust fan 181.

Although the image forming apparatus including the line head of the invention has been described with respect to the embodiments, the invention is not limited thereto, and various modifications can be made.

What is claimed is:

1. A line head module comprising:

a line head in which a plurality of organic EL elements is arranged;

a lens array made by arranging lens elements which focus light from the line head; and a head case supporting the line head and the lens array, the head case including a side wall with an inner peripheral surface, the inner peripheral surface being formed with a stepped seat along the entire periphery thereof and a slit-shaped opening portion at a lower end portion thereof, the line head being provided with an element substrate, a first electrode formed on the element substrate, a second electrode formed so as to face the first electrode, a functional layer formed between the first and second electrodes and including at least a light-emitting layer, and a seal substrate attached to the element substrate via an adhesive arranged on the second electrode, the lens array being arranged in the slit-shaped opening portion of the head case, a first seal member being arranged in a corner between the lens array and the entire inner periphery of the lower end portion of the head case so as to airtightly join the lens array to the head case, the line head being arranged on the stepped seat of the head case, a second seal member being arranged in a space between the entire inner periphery surface of the head case and an entire outer periphery of the side surface of the line head, so as to airtightly join the line head to the head case, and to form an airtight seal in a first chamber formed between the line head and the lens array, and the second seal member covering the entire peripheral side surface of the seal substrate, the adhesive, and the element substrate, and covering a part of the upper surface of the seal substrate.

2. The line head module according to claim 1, a getter agent being disposed in the first chamber.

3. The line head module according to claim 1, a sealing material containing a getter agent being disposed in a connected part where the line head or/and the lens array and the head case are airtightly connected together.

4. An image forming apparatus comprising:

the line head module according to claim 1 as an exposing unit.

* * * * *